United States Patent [19]

Beekhuis

[11] 4,339,481

[45] Jul. 13, 1982

[54] PROCESS AND APPARATUS FOR APPLYING LIQUID TO WEB MATERIAL

[75] Inventor: Lambert J. Beekhuis, Mierlo, Netherlands

[73] Assignee: Vlisco B.V., Helmond, Netherlands

[21] Appl. No.: 142,991

[22] Filed: Apr. 23, 1980

Related U.S. Application Data

[63] Continuation-in-part of Ser. No. 659,143, Feb. 18, 1976, abandoned.

[30] Foreign Application Priority Data

Feb. 18, 1975 [NL] Netherlands ..... 7501900

[51] Int. Cl.[3] ..... B05D 1/28

[52] U.S. Cl. ..... 427/428; 118/249; 118/262

[58] Field of Search ..... 427/428; 118/249, 262

[56] References Cited

U.S. PATENT DOCUMENTS 2,380,047 7/1945 Hyman ..... 427/428

3,735,733 5/1973 Henc ..... 118/202

OTHER PUBLICATIONS

Booth, G. L., *Coating Equipment and Processes,* N.Y. Lockwood Publ., 1970, pp. 152 and 153.

*Primary Examiner*—Norman Morgenstern

*Assistant Examiner*—Janyce A. Bell

*Attorney, Agent, or Firm*—Cushman, Darby & Cushman

[57] ABSTRACT

A process for applying exactly metered small quantities of liquid to web material, such as textile. The web material is passed through the nip of a pair of rollers. One of the rollers is provided with a film of liquid by means of an applicator roller which is partly immersed in a liquid bath and which rotates in contact with it. The applicator roller has a surface provided with raised portions and recesses, which makes it possible to apply the liquid in small, reproducible dosage.

4 Claims, 4 Drawing Figures

PROCESS AND APPARATUS FOR APPLYING LIQUID TO WEB MATERIAL

This is a continuation-in-part of Aplicant's co-pending U.S. patent application Ser. No. 659,143 filed Feb. 18, 1976, now abandoned.

BACKGROUND AND SUMMARY OF THE INVENTION

This invention relates to a process for applying a relatively nonviscous liquid to web material, such as textile, in which process the web material is passed through the nip of a pair of rollers, one of which, hereinafter called the intermediate roller, is provided with a film of liquid by means of an applicator roller which is partly immersed in a liquid bath and which rotates in contact with said intermediate roller.

In such a process, for example the applicator roller has a chromium-plated surface, while the intermediate roller in contact with the applicator roller is coated with rubber. This rubber intermediate roller as it were rubs off the applicator roller, so that a thin film of liquid is left behind on the surface of the rubber intermediate roller. This film of liquid is transferred to the web material, which is pressed onto the rubber intermediate roller by the upper roller.

The object of such a manner of applying liquid is to apply an exactly metered small quantity of liquid in even distribution over the surface of the web material. The application of an exactly metered quantity of liquid in even distribution is of great importance for various textile processes. The quantity of liquid applied ranges, for example, from 7.5 to 15 grams per $m^2$ of material.

In practice it has been found that it is difficult to apply a small, metered quantity of liquid over the surface of the web material in even distribution. The quantity applied is strongly dependent on the peripheral velocity of the rollers, that is, the velocity of passage of the web material.

The invention contemplates a process wherein this drawback is avoided and wherein it is possible to apply the liquid in a small, reproducible dosage.

For this purpose there is used according to the invention an applicator roller, the surface of which is provided with raised portions and recesses. In this way high pressures are avoided in the nip between the applicator roller and the intermediate roller co-acting therewith, so that the two rollers can remain practically in contact with each other over their entire widths independent of the rotation velocity, a suitable nip pressure, falling in the range 0.1 to 0.2 kg/cm. No additional pressure, as for example from hydraulic or pneumatic hold-down cylinders operating on the pins of the top roller is needed. The quantity of liquid transferred as a liquid film to the intermediate roller has a certain thickness which is independent of the velocity of the web and only depends on the surface profile of the applicator roller. The liquids to be applied are generally nonviscous and the use of a doctor blade to remove excess liquid from the intermediate or applicator roller is not needed.

In a preferred embodiment of the process according to the invention there is used an applicator roller having a metal surface provided with cup-shaped recesses. In practice it has been found that the thickness of the liquid film depends on the number and the depth of said cup-shaped recesses, so that in order to obtain a determined, small quantity of liquid in the web material it is only the choice of the right applicator roller that is decisive.

Furthermore, according to the invention, the top roller of the pair of rollers may rest with its own weight on the intermediate roller, which intermediate roller rests on the applicator roller. Surprisingly, it has been found that the pressure resulting from the weights of the rollers promotes uniformity of the liquid distribution. The weight of the top roller and the construction of the top and intermediate roller surfaces should be chosen so that the nip pressure between the two rollers is very light, ordinarily less than approximately 0.2 kg/cm.

The process of the present invention makes it possible to apply any desired quantity of liquid to the web material by employing a plurality of applicator rollers, each of which transfers a determined standard quantity of liquid. This is advantageous in that small quantities of liquid, applied at intervals, still further increase the already high uniformity, because the absorption capacity of textile may set restrictions to the quantity of liquid that can be uniformly applied by means of one nip. According to the invention the web material can accordingly be passed through a plurality of pairs of rollers, each comprising one roller arranged to co-act with an applicator roller designed to transfer a determined quantity of liquid.

In order to avoid the occurrence of an asymmetric moisture gradient in the direction of the thickness of the web material, according to another feature of the invention the liquid can successively be applied to both sides of the web material by running the web through a plurality of pairs of rollers.

Furthermore, the invention relates to an apparatus for applying liquid to web material, such as textile, which comprises a pair of rollers forming a nip through which the web material can be passed, and an applicator roller which can rotate partly immersed in a liquid bath and which can co-act with one of said pair of rollers for transferring liquid thereto. According to the invention the apparatus is characterized in that the applicator roller has a surface which is provided with raised portions and/or recesses.

According to the invention there may be provided cup-shaped recesses in the surface of the applicator roller, which ensures a proper control of the quantity of liquid to be applied.

Furthermore, according to the invention the rollers and the applicator roller may be freely rotatable. The advancing web material will then drive all the rollers as it travels through them, so that no further drive means are required. Consequently, the apparatus can easily be fitted at a desired location in a web treating process.

Moreover, according to the invention, the apparatus may comprise a plurality of pairs of rollers, through which the web material can be passed, each pair of rollers being adapted to transfer a determined quantity of liquid to the web and at least one pair of rollers being disengageable by spacing the nip, so that the other pairs of rollers together apply the desired quantity of liquid.

One embodiment of the invention will now be described with reference to the accompanying drawings, wherein.

Figure 1:
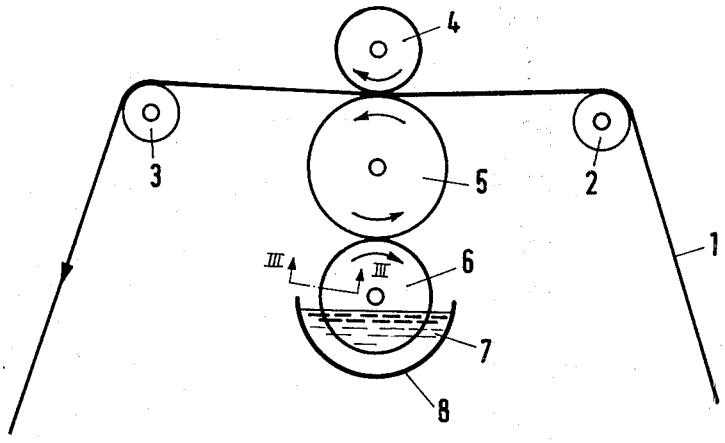
FIG. 1 is a schematic sideview of the apparatus according to the present invention.

FIG. 1 shows a web material 1 which by means of guide rollers 2 and 3 is passed through the nip of a pair of rollers 4, 5. The direction of movement and of rotation is indicated by arrows. Pressure roller 4 presses the web material onto the, for example, rubber intermediate roller 5 with nip pressure in the approximate range 0.1 to 0.2 kg/cm. Roller 5 is provided with a film of liquid by means of applicator roller 6 and transfers same to the web material. Applicator roller 6 rotates partly immersed in liquid 7 contained in liquid bath 8. Rollers 4, 5 and 6 are driven by the advancing movement of web material 1.

Figure 3:
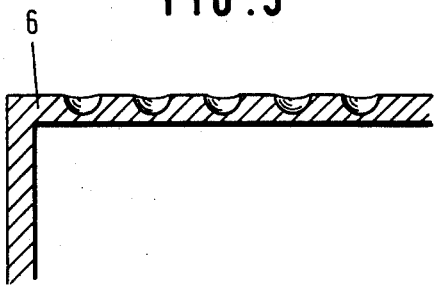
FIG. 3 is an enlarged cross-sectional view on the line III—III of FIG. 1, showing one form of applicator roller surface according to the invention.

The, for example, metal surface of applicator roller 6 is provided with cup-shaped recesses 9 (FIG. 3). It has been found that by varying the number and the depth of said cup-shaped recesses it is possible to accurately control the thickness of the liquid film.

Figure 2:
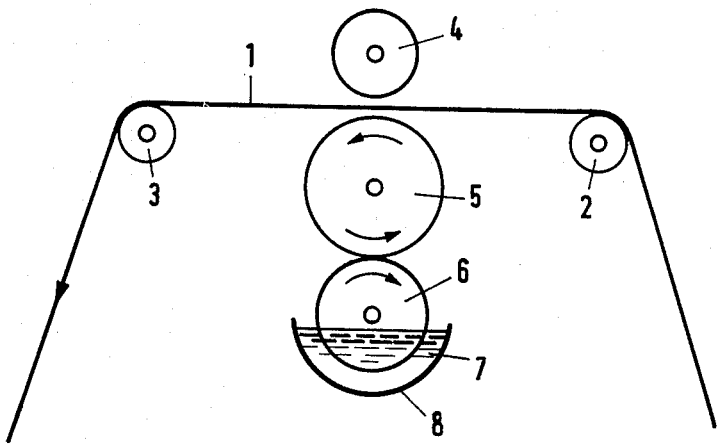
FIG. 2 shows the arrangement of FIG. 1 in the inoperative position.

FIG. 2 shows the same apparatus as FIG. 1 and is provided with corresponding reference numerals. However, rollers 4 and 5 are vertically spaced, so that the web material passes freely and rollers 4, 5 and 6 are not driven.

Figure 4:
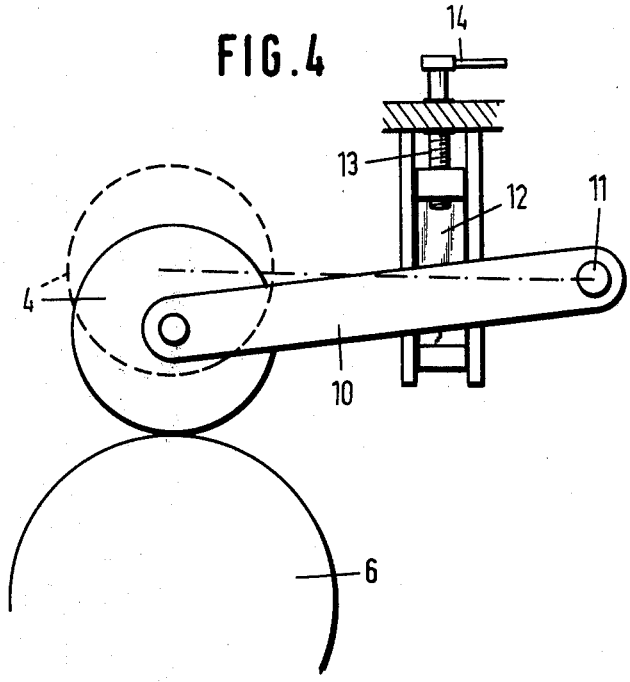
FIG. 4 shows an arrangement for spacing the pair of rollers in diagrammatic sideview.

FIG. 4 shows roller 4 attached to an arm 10 pivoting about a shaft 11. Arm 10 is movable up and down by means of a fork 12 controlled by a set screw 13 having a handle 14. In the lowermost position of roller 4 as shown, roller 4 rests on roller 5 and the arrangement of rollers will be driven by web 1 passing through them. In the upper position of roller 4, as shown in ghost outline, the arrangement is in the inoperative state. This construction is of special importance in arrangements comprising a plurality of pairs of rollers, each associated with a different applicator roller according to the present invention.

What is claimed is:

1. Apparatus for applying liquid having low viscosity to web material such as textile without the aid of a doctor blade, comprising: a freely rotatable top roller supported from below by engagement with a freely rotatable intermediate roller which forms a nip for receiving an advancing length of the web, said top roller and intermediate roller developing a pressure in said nip which is less then approximately 0.2 kg/cm so that the advancing web rotates said rollers and a freely rotatable applicator roll engaging said intermediate roller from below and supporting said intermediate roller and said top roller whereby said applicator roll is rotated by said intermediate roller, said applicator roll being partially immersed in a bath of the liquid to be applied and having a metal surface provided with cup-shaped recesses.

2. A process for applying liquid having low viscosity to an advancing textile web without the use of a doctor blade, comprising: passing the advancing web through a nip formed between a top freely rotatable roller and an intermediate freely rotatable roller which supports the top roller whereby the advancing web rotates the rollers, the top and intermediate rollers developing a pressure in the nip which is less than approximately 0.2 kg/cm; and transferring liquid from a bath thereof to the intermediate roller in the form of a film thereof by a freely rotatable applicator roller which is partially immersed in the bath, which applicator roller supports the intermediate roller from below so as to be rotated by the intermediate roller and which has a metal surface provided with cup-shaped recesses.

3. A process as in claim 2, wherein at least the surface of the intermediate roller is elastic.

4. Apparatus as in claim 1, wherein at least the surface of the intermediate roller is elastic.

* * * * *